US005889497A

United States Patent [19]

Brooker et al.

[11] Patent Number: 5,889,497

[45] Date of Patent: Mar. 30, 1999

[54] ULTRAWIDEBAND TRANSVERSE ELECTROMAGNETIC MODE HORN TRANSMITTER AND ANTENNA

[75] Inventors: Clive John Brooker, Farnborough; Paul Denis Smith, St. Andrews, both of United Kingdom

[73] Assignee: The Secretary of State for Defence in Her Britannic Majesty's Government of the United Kingdom of Great Britain and Northern Ireland, Hants, United Kingdom

[21] Appl. No.: 737,476

[22] PCT Filed: May 18, 1995

[86] PCT No.: PCT/GB95/01127

§ 371 Date: Nov. 20, 1996

§ 102(e) Date: Nov. 20, 1996

[87] PCT Pub. No.: WO95/32529

PCT Pub. Date: Nov. 30, 1995

[30] Foreign Application Priority Data

May 20, 1994 [GB] United Kingdom ..... 9410274

[51] Int. Cl.[6] ..... H01Q 13/00

[52] U.S. Cl. ..... 343/786; 343/772; 343/785

[58] Field of Search ..... 343/786, 772, 343/783, 784, 785

[56] References Cited

U.S. PATENT DOCUMENTS

| | | | |
|---|---|---|---|
| 2,202,380 | 5/1940 | Hollmann | 343/786 |
| 2,829,366 | 4/1958 | Armstrong et al. | 343/837 |
| 3,659,203 | 4/1972 | Ross et al. | 325/105 |
| 4,641,528 | 2/1987 | Clayland, Jr. et al. | 73/597 |
| 5,729,470 | 3/1998 | Baier et al. | 364/497 |

FOREIGN PATENT DOCUMENTS

| | | |
|---|---|---|
| A0465845 | 1/1992 | European Pat. Off. . |
| 598493 | 3/1948 | United Kingdom . |

OTHER PUBLICATIONS

Measurement Techniques, vol. 37, No. 2, Feb. 1994 New York U.S., pp. 199–204, XP 000468274 AL Betkov et al., "Experiments on Measurement Transducers Using a TEM Horn".

*Primary Examiner*—Hoanganh Le
*Attorney, Agent, or Firm*—Nixon & Vanderhye PC

[57] ABSTRACT

An ultrawideband transverse electromagnetic mode horn antenna for use at high voltages, comprises a pulse generator (1) and two transmission horns (12, 18) containing different dielectric media. The interface (30) between the dielectric media is configured so that a signal from the generator is incident on the interface at an angle substantially equal to the Brewster angle, thereby maintaining a good impedance match across the interface. A further advantage of the arrangement is that the TEM wavefront is preserved through the antenna section allowing operation at fast pulse risetime (less than 200 ps) for short duration (several ns) at high voltage.

22 Claims, 3 Drawing Sheets

ULTRAWIDEBAND TRANSVERSE ELECTROMAGNETIC MODE HORN TRANSMITTER AND ANTENNA

BACKGROUND OF THE INVENTION

1. Field of the Invention

The invention relates to an ultrawideband antenna incorporating a pulse generator for use in transverse electromagnetic mode (TEM), particularly for use at high voltages.

2. Discussion of Prior Art

There is a desire to develop antenna capable of operating with pulses of increasingly high voltage, short duration and rapid pulse risetime and repetition rate, for example for application in wide bandwidth high definition radar systems. The transmission line geometry of such an antenna required to ensure good transmission of pulse energy is a principal area of concern, having associated problems which are exacerbated under higher voltage and rapid pulse risetime conditions.

In these antennae, the dielectric medium which contains the generator and the dielectric medium from which the signal is radiated away from the antenna are likely to be different, the former for example a dielectric polymer or transformer oil and the latter for example air or other suitable gas. Problems are encountered where the pulse signal output from the generator makes the transition between the dielectric media. To minimize degradation of the signal by reflection at an interface it is desirable to minimize impedance variation across it. The two media will possess different dielectric properties however, so that a transmission line having a continuous geometry at the interface will necessarily produce impedance discontinuities, so that reflection will occur. Impedance matching for a normally incident signal can be achieved by incorporating geometric discontinuities at the interface but this can also be expected to produce degradation of pulse quality. A further important consideration in determining geometry arises from the need to maintain an insulating condition in the transmission line to avoid breakdown. Voltage holdoff may reach 30 kV/cm in air at atmospheric pressure which will determine the minimum plate separation for an air filled transmission line at a given voltage. These factors place limits on the voltage or necessitate use of a pulse having a longer risetime.

SUMMARY OF THE INVENTION

The present invention aims to provide an antenna which offers good impedance matching at the interface of the two dielectric media so as to preserve a rapid risetime at high voltage operation.

Thus according to the present invention there is provided an antenna comprising an electromagnetic pulse generator, a first transverse electromagnetic mode transmission line containing a first dielectric medium, and a second transverse electromagnetic mode transmission line containing a second dielectric medium, serially connected so as to enable transmission of a signal from the generator to the second transmission line, wherein the first transmission line incorporates a transition element providing an interface between the first and second dielectric media which is so configured that a signal from the generator is incident on the interface at an angle substantially equal to the Brewster Angle.

It will be appreciated that for a given pair of homogeneous dielectric materials the Brewster Angle represents the angle at which a plane wave incident on a planar dielectric interface with the magnetic field in a direction parallel to the plane of the interface will undergo no reflection. For a wave passing from medium 2 of higher refractive index and permittivity $\epsilon 2$ to medium 1 of lower refractive index and permittivity $\epsilon 1$ the angles $\Psi 1$ and $\Psi 2$ are given by $$\tan \Psi 2=\sqrt{(\epsilon 2/\epsilon 1)} \text{ and } \tan\Psi 1=\sqrt{(\epsilon 1/\epsilon 2)}$$

$$\Psi 1+\Psi 2=\pi/2.$$

For a polymethylmethacrylate to air transition, for example, these angles are $\Psi 2=58.7°$ and $\Psi 1=31.3°$. In order to use this principle to match the impedances of two TEM horns which are located on either side of the media interface and meet along it consider firstly two striplines in media 1 and 2 of heights H1 and H2 of equal width W. Then $$\frac{H1}{H2} = \frac{\sin\Psi 1}{\sin\Psi 2} = \tan\Psi 1 - \sqrt{\epsilon 1/\epsilon 2)}$$

This implies that the impedance of the striplines (given approximately by $Z_O(H1/W)$ and $Z_O\sqrt{(\epsilon 1/\epsilon 2)}$ (H2/W) when H1,H2<<W) are matched across the interface (ignoring any effects arising from the finite width of the stripline). The striplines can be replaced by TEM horn elements provided their elevation and taper is shallow to ensure that the wavefront arriving at the interface is nearly planar ; small deviations from exact planarity will produce small reflections.

Use of the Brewster Angle concept in this way provides a method of configuring the dielectric transition which maintains a good impedance match across the transition. At the same time geometric discontinuities at the interface which inevitably arise with impedance matching for normal incidence are reduced. The TEM wavefront structure is preserved through the antenna section and allows operation on at fast pulse risetime (less than 200 ps) for short duration (several ns) at high voltage.

The second dielectric medium is often conveniently gaseous. For many applications it is usefully the same as the medium into which the antenna is to be used to broadcast a signal, and hence for most operations the second dielectric medium is conveniently air. However, for some applications it is desirable to use as the second dielectric medium a gaseous dielectric with a higher breakdown potential than air, to allow operation at higher voltage at a given geometry. A range of such gases. for example $SF_6$, can be considered for this purpose.

The interface between the first dielectric medium and the second dielectric medium must be accurately configured, and this is conveniently achieved when the first dielectric medium possesses reasonable rigidity and machinability. Polymeric materials such as polymethylmethacrylate (PMMA), polystyrene. polytetrafluoroethylene (PTFE) and the like are suitable for this purpose. Alternatively, the first dielectric medium may comprise a liquid dielectric such as transformer oil in combination with an interface element of rigid material and substantially similar dielectric constant to the liquid to constrain the liquid and provide an accurate interface.

The invention is particularly appropriate to operation with pulses at high voltage and rapid risetime. The electromagnetic pulse generator is therefore preferably capable in use of generating a pulse at a voltage greater than 30 kV, more preferably greater than 60 kV, most preferably greater than 100 kV, and is preferably capable in use of generating a pulse having a risetime of less than 200 ps, more preferably less than 120 ps. The pulses are also preferably of short duration (of the order of a few nanoseconds). To achieve signals within these parameters, the electromagnetic pulse generator preferably includes signal sharpening means such as a spark gap or ferrite sharpening lines.

The first and second transmission lines may in a simple embodiment each comprise parallel conducting plate transmission lines, but much improved performance can be obtained when one or both of the transmission lines comprise a transverse electromagnetic mode horn. The Brewster Angle concept applied herein requires a plane wave incident on a planar boundary with a magnetic component parallel to the planar boundary. It is apparent therefore that the wavefront must maintain characteristics approximating to planarity as it passes through the transmission means, so that the angular separation between upper and lower conductors of the horn and the apex angle must be sufficiently small to maintain approximate planarity of the wavefront. Within these constraints the radiated field strength from the antenna can be maximized by reducing impedance mismatch between the aperture of the second horn which serves to radiate the signal from the antenna, and the medium into which the signal is radiated (usually this will mean matching up with the impedance of air/free space). This must be done whilst retaining impedance matching at the dielectric interface, so the second horn is preferably profiled such that its impedance increases with distance from the interface towards an aperture so as to be substantially matched at the aperture to the impedance of the medium into which the horn radiates. In addition, the second horn may be resistively loaded in order to attenuate currents reflected from the antenna aperture, which currents can cause undesirable features in the radiated pulse.

BRIEF DESCRIPTION OF THE DRAWINGS

The invention will now be described by way of example only with reference to FIGS. 1 to 5 in which.

DETAILED DISCUSSION OF PREFERRED EMBODIMENTS

Figure 1:
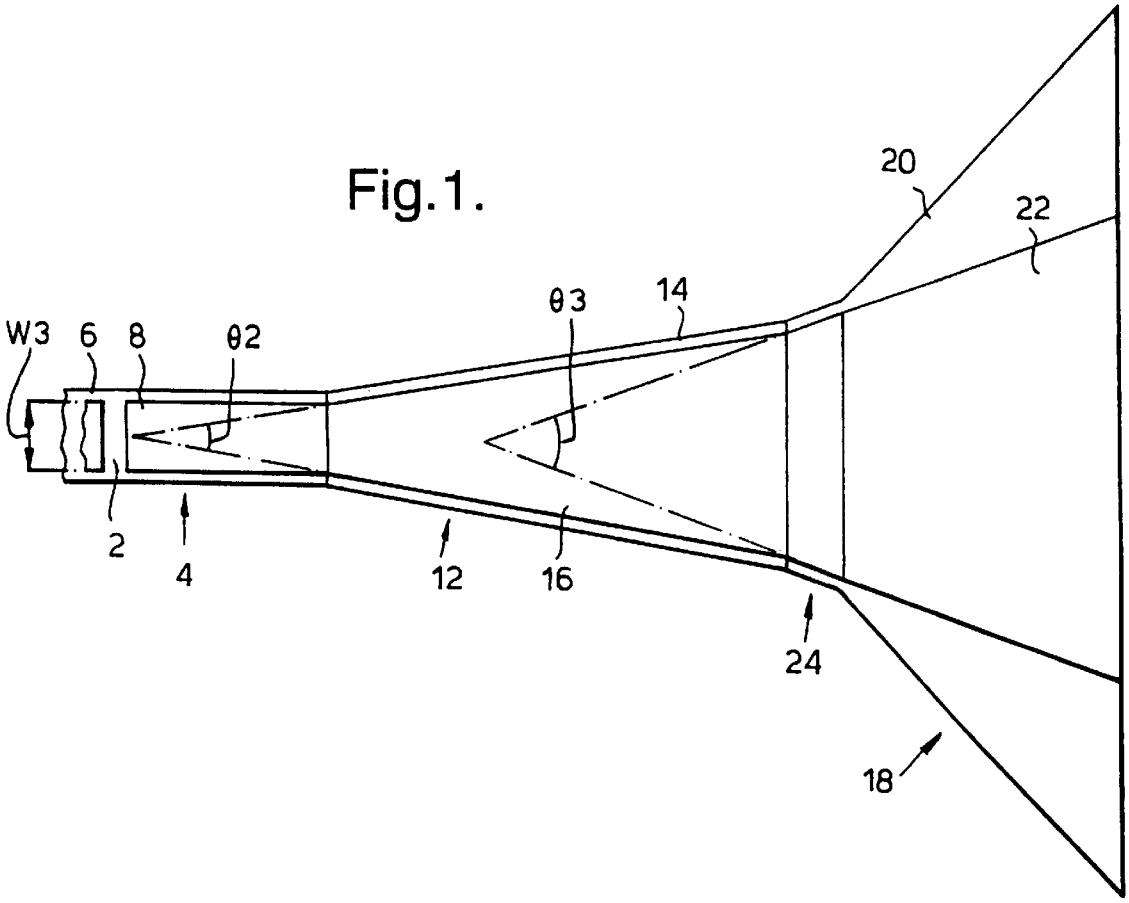
FIG. 1 is a plan view of a ground plane antenna according to an embodiment of the invention.
Figure 2:
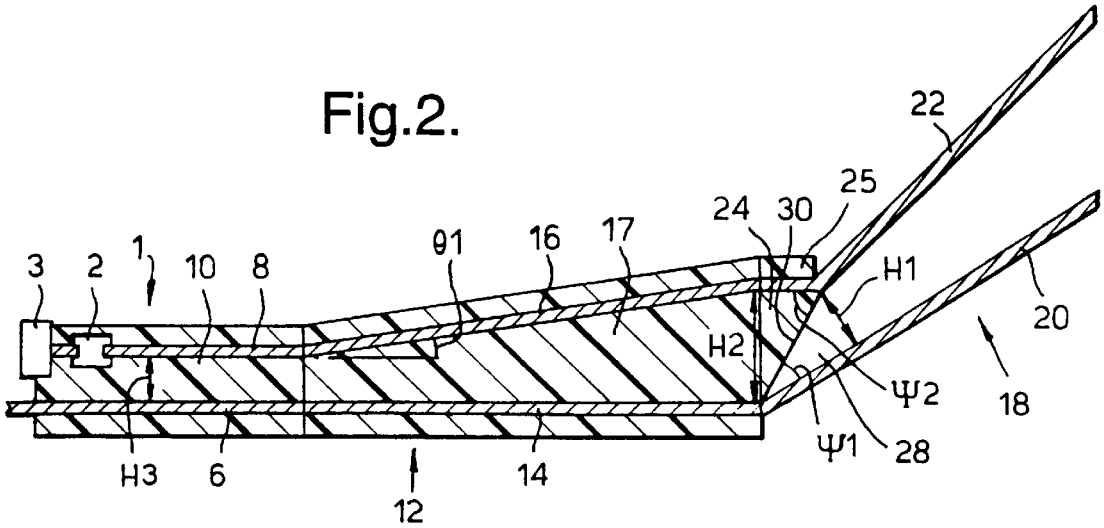
FIG. 2 is a longitudinal cross section of the antenna of FIG. 1.

In FIGS. 1 and 2 there is provided a ground plane antenna designed to operate at 50 ohm impedance. An electromagnetic pulse generator 1 is made up of a spark gap generator incorporating a pulser 3 and a spark gap 2, and a parallel plate transmission line feed 4 which comprises a grounded plate 6 and parallel upper plate 8 having PMMA as a dielectric 10. For 50 ohm operation with a PMMA dielectric the transmission line feed 4 requires a width/height ratio (W3/H3) of approximately 2.4. The feed enables the sharpened pulse signal output from the spark gap 2 to be passed to a PMMA filled TEM horn 12. The spark gap may alternatively be configured so that it lies across and shorts the plates 6 and 8 so that the rear of the applied pulse is sharpened rather than the front as would otherwise be the case. The spark gap medium may be solid, gaseous or liquid.

The horn 12 has a grounded plate 14 and an upper plate 16 maintained at an angle of elevation thereto θ1 which is kept shallow to ensure that the wavefront maintains characteristics approximating to planarity which are necessary for the Brewster Angle principle to be applied. In this particular embodiment 8.5° has been found an optimum compromise for the angle θ1 between the advantages which a horn antenna offers over a simple stripline and the need to maintain an approximately planar wavefront. The plates 14, 16 are configured to produce a horn with an apex angle θ2 of 19.5°.

The second transmission line, from which the signal is radiated away from the antenna, is an air filled TEM horn 18 comprising a ground plate 20 and upper plate 22 configured to give a virtual apex angle θ3 of 40°. The upper plate 22 is maintained at an angle of elevation of 8.5° relative to the grounded plate 20.

Between the air filled horn 18 and the PMMA filled horn 12 there is provided a transition element 24. The transition element 24 has an upper plate 25 with the grounded plate 20 serving as its lower plate, partly containing a PMMA dielectric which is continuous with the PMMA dielectric in the horn 12 and parallel plate line feed 4, and also containing air 28 which is continuous with the air in the horn 18. The interface between the two media 30 is shaped to ensure the wavefront is incident at the Brewster Angle for a PMMA air transition, which requires angles Ψ1 and Ψ2 to be 31.3° and 58.7° respectively The heights H2, H1, and hence the other dimensions of the antenna, are governed by the need to avoid breakdown of the signal and hence are determined by the operating voltage. For 30 kV operation H2=58 mm and H1=35 mm are found acceptable, and this enables the length of the PMMA horn to be kept reasonably short (30 cm with this geometry) so that dispersion of the signal is kept sufficiently low to allow operation with pulse risetimes of the order of 120 ps. For higher voltage operation H2 and H1 may be increased, but the corresponding increase in length of the PMMA filled horn will increase the minimum usable pulse risetime, and it may therefore be preferable to consider other modifications, such as a sulphur hexafluoride jacket in the transition region.

For ease of manufacture the conducting plates 6, 8, 14, 16, 20, 22 and 25 are constructed from aluminium, but alternatives will readily suggest themselves as appropriate to those skilled in the art.

Figure 3:
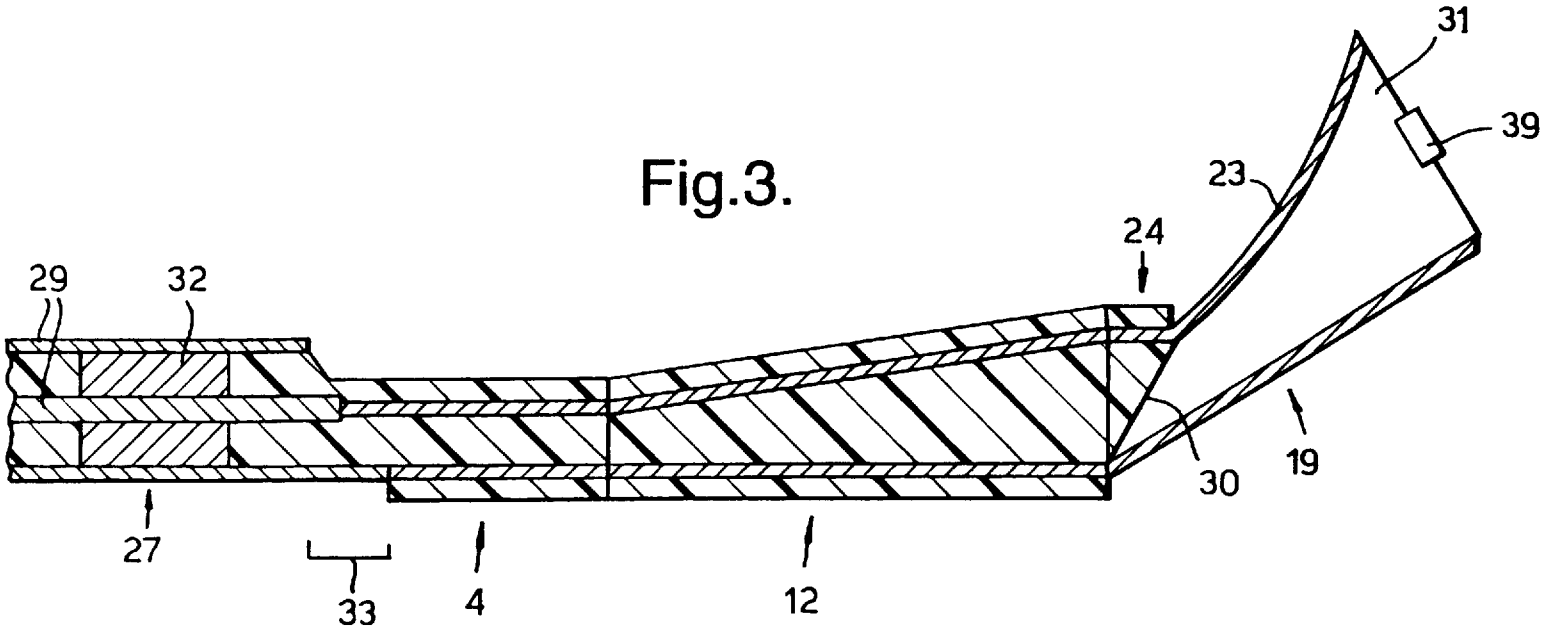
FIG. 3 is a longitudinal cross section of a modified ground plane antenna based on the embodiment of FIGS. 1 and 2.

FIG. 3 illustrates a modification of the antenna of FIGS. 1 and 2, and like numerals are used to designate like components where appropriate. In this embodiment there is provided a stripline feed 4, PMMA filled horn 12, and transition element 24 of equivalent design to the above. However, this embodiment sharpens the signal by means of a ferrite sharpening line 27. A signal from a pulser (not shown) is passed to a coaxial line comprising a pair of coaxial conductors 29 with a length of ferrite material 32 included in the core to effect sharpening. The sharpened signal passes via a coaxial/stripline converter 33 to the stripline 4, and thence to the first TEM horn 12 as in the earlier embodiment. A spark gap may also be configured as coaxial, in which case a similar coaxial to stripline converter 33 is required.

As the antennae in these embodiments are designed for 50 ohm operation there is appreciable impedance mismatch with free space when the signal reaches the air filled horn aperture of the earlier embodiment. To mitigate this, the embodiment illustrated in FIG. 3 includes an alternative air filled horn 19, having an upper plate 23 which is no longer planar but is instead divergently curved away from the ground plate 21 so that the height to width ratio, and hence the impedance, increases between dielectric interface 30 and aperture 31. The impedance at the aperture thereby more nearly coincides with that of free space allowing radiated field strength to be maximized.

In addition, undesirable reflections from a mismatched antenna aperture may be reduced by applying a resistive loading across the ground plate 20 and upper plate 22 in order to provide a continuously increasing resistive profile between the dielectric interface 30 and aperture 31. This can be achieved by applying a resistive coating or chip resistors to one or both of the plates to approximate such a load or a resistive termination to ground could be applied to the ends of the antenna. For example, two 100 ohm resistors 39 connected in parallel between the ground plate 20 and the upper plate 22 at their aperture ends would match 50 ohm assumed impedance of the antenna.

Figure 4:
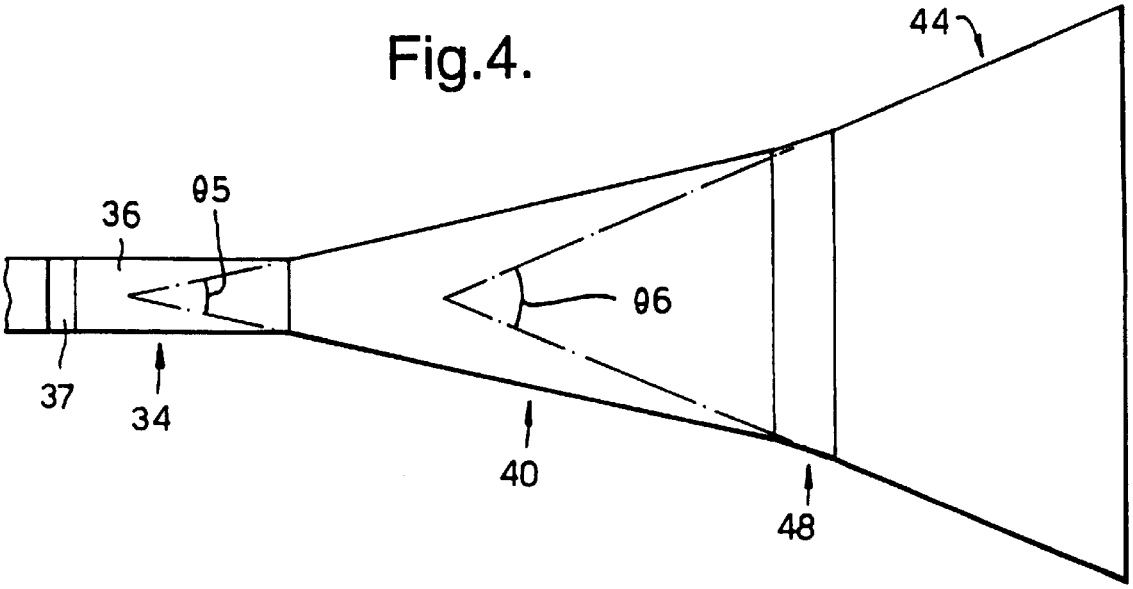
FIG. 4 is a plan view of a free field antenna according to an alternative embodiment of the invention.
Figure 5:
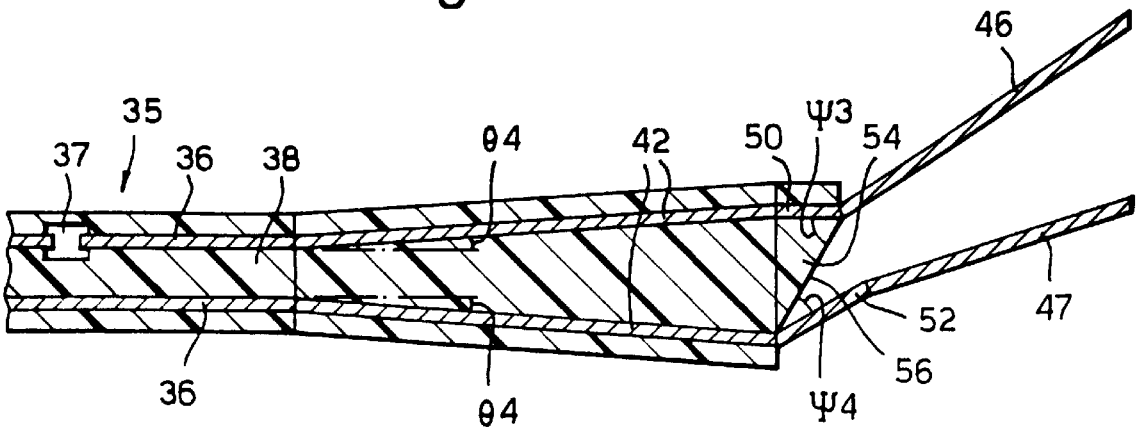
FIG. 5 is a longitudinal cross section of the antenna of FIG. 4.

In FIGS. 4 and 5 there is provided a free field antenna configured according to similar principles to the ground plane antenna in FIGS. 1 and 2.

A pulse generator 35 is provided in which pulse sharpening is effected by means of a spark gap 37. A parallel plate transmission line feed 34 which comprises parallel conducting plates 36 containing a PMMA dielectric 38 is used to transmit the fast risetime short duration pulse to a PMMA filled TEM horn 40. The horn 40 has a pair of aluminium plates 42 configured to have an angular separation of 8° (that is, the angles θ2 are 4°) and the plates are flared at an angle of 12.75° to produce an apex angle θ5 of 25.5°. These are again chosen to ensure that the wavefront maintains characteristics approximating to planarity. The second transmission means again comprises an air filled TEM horn 44 made up of a pair of aluminium plates 46, 47 configured to the same 8° angular separation and flared at 23° to produce a virtual apex angle θ6 of 46°.

The transition element 48 consists of an upper aluminium plate 50 which lies in a plane parallel to that of the transmission line 34 and a lower aluminium plate 52. The PMMA dielectric in the transition zone 54 is shaped to ensure an angle of incidence at the interface 56 with air corresponding to the Brewster angle, so that Ψ3 is 58.7° and the lower plate 52 is at an angle Ψ4 to the interface 56 of 31.3°. The height to width cross-sectional ratio of the upper antenna arm 46 must be approximately equal to that of a notional 50 ohm air filled stripline to minimize any mismatch. This requires a slight flaring of the upper plate 50 in the transition element over and above the 12.75° flaring of the plates 42. Similar considerations lead to a flaring angle for the lower plate 52 in the transition element which is less than 12.75°. The angles involved do not create major discontinuities within this region, so any mismatch will be small, of the order of 10% or less.

Individual antenna elements may be assembled as an array in order to increase the radiated power.

We claim:

1. An antenna for transmitting an ultrawideband electromagnetic pulse from an electromagnetic pulse generator, said antenna comprising:

a first transverse electromagnetic mode transmission line containing a first dielectric medium, and a second transverse electromagnetic mode transmission line containing a second dielectric medium, serially connected so as to enable transmission of a signal from said first dielectric medium to the second transmission line, and a transition element providing an interface between the first and second dielectric media, said first and second transmission lines and said transition element configured such that a signal from the first transmission line is incident on the interface at an angle substantially equal to the Brewster Angle.

2. Antenna according to claim 1 wherein the second dielectric medium is air.

3. Antenna according to claim 1 wherein the second dielectric medium is a gaseous dielectric with a higher breakdown potential than air.

4. Antenna according to claim 1 wherein the first dielectric medium is selected from the group comprising polymethylmethacrylate, polystyrene, and polytetrafluoroethylene.

5. Antenna according to claim 1 wherein the first transmission line comprises a first transverse electromagnetic mode horn.

6. Antenna according to claim 1 wherein the second transmission line comprises a second transverse electromagnetic mode horn.

7. Antenna according to claim 6 wherein the second horn is profiled such that its impedance increases with distance from the interface towards an aperture so as to be substantially matched at the aperture to the impedance of the medium into which the horn radiates.

8. Antenna according to claim 6 wherein the second horn is resistively loaded such that its resistive profile increases with distance from the interface towards an aperture so as to be substantially matched at the aperture to the impedance of the medium into which the horn radiates.

9. Antenna according to claim 1, wherein said first transmission line comprises a grounded plate and an upper plate, said plates separated by said first dielectric medium, said upper plate having an angle of elevation θ1 with respect to said lower plate, said angle θ1 maintained shallow enough such that a wavefront of said pulse in said first transmission line is substantially planar.

10. Antenna according to claim 9, wherein said angle θ1 is substantially 8.5 degrees.

11. Antenna according to claim 1, wherein said first transmission line comprises a grounded plate and an upper plate, said plates separated by said first dielectric medium, said second transmission line comprises a grounded plate and an upper plate, said plates separated by said second dielectric medium, said first and second transmission lines upper and lower plates having an angle of elevation θ1 with respect to said first and second transmission lines lower plates, said angle θ1 maintained shallow enough such that a wavefront of said pulse in said first transmission line is substantially planar.

12. Antenna according to claim 1, wherein said transition element comprises:

an upper plate section; and a dielectric medium, said transition element dielectric medium the same as said first dielectric medium, and using said second transmission line lower plate section, said transition element upper plate section parallel with said first transmission line lower plate, said transition element dielectric continuous with said first dielectric medium and having a planar interface with said second dielectric medium, said second transmission line lower plate section disposed at a first Brewster Angle Ψ1 with respect to said planar interface and said transition element upper plate disposed at a second Brewster Angle Ψ2 with respect to said planar interface.

13. Antenna according to claim 12, wherein said first dielectric medium is polymethylmethacrylate, said second dielectric medium is air, said first Brewster Angle Ψ1 is substantially 31.3 degrees and said second Brewster Angle $\Psi 2$ is substantially 58.7 degrees.

14. A transmitter for transmitting an ultrawideband electromagnetic signal, said transmitter comprising:

an electromagnetic pulse generator for generating an electromagnetic signal;

a first transverse electromagnetic mode transmission line containing a first dielectric medium for receiving said electromagnetic signal from said generator;

a second transverse electromagnetic mode transmission line containing a second dielectric medium, serially connected so as to enable transmission of said signal from said first dielectric medium to the second transmission line; and a transition element providing an interface between the first and second dielectric media which is so configured that said signal from the generator is incident on the interface at an angle substantially equal to the Brewster Angle.

15. Antenna according to claim 14 wherein the electromagnetic pulse generator is capable of generating a pulse at a voltage greater than 30 kV.

16. Antenna according to claim 15 wherein the electromagnetic pulse generator is capable of generating a pulse at a voltage greater than 60 kV.

17. Antenna according to claim 16 wherein the electromagnetic pulse generator is capable of generating a pulse at a voltage greater than 100 kV.

18. Antenna according to claim 14 wherein the electromagnetic pulse generator is capable of generating a pulse having a risetime of less than 200 ps.

19. Antenna according to claim 18 wherein the electromagnetic pulse generator is capable of generating a pulse having a risetime of less than 120 ps.

20. Antenna according to claim 14 wherein the electromagnetic pulse generator includes signal sharpening means.

21. Antenna according to claim 20 wherein the signal sharpening means comprises a spark gap.

22. Antenna according to claim 20 wherein the signal sharpening means comprises ferrite sharpening lines.

* * * * *